United States Patent [19]

Pappanikolaou

[11] Patent Number: 4,760,601

[45] Date of Patent: Jul. 26, 1988

[54] SINGLE SPEAKER, DOUBLE TUNED LABYRINTH TYPE ENCLOSURE

[76] Inventor: Sofia Pappanikolaou, 621 90th St., Brooklyn, N.Y. 11228

[21] Appl. No.: 63,984

[22] Filed: Jun. 19, 1987

[51] Int. Cl.[4] ..... H04R 1/02

[52] U.S. Cl. ..... 381/90; 381/205

[58] Field of Search ..... 381/88, 89, 90, 188, 381/205; 181/152, 156

[56] References Cited

U.S. PATENT DOCUMENTS

| | | | |
|---|---|---|---|
| 2,806,547 | 9/1957 | Sewell | 181/156 |
| 3,608,665 | 9/1971 | Drisi | 381/89 |
| 4,235,301 | 11/1980 | Mitchell | 181/152 |

FOREIGN PATENT DOCUMENTS

| | | | |
|---|---|---|---|
| 2260912 | 6/1973 | Fed. Rep. of Germany | 381/89 |
| 2631371 | 1/1978 | Fed. Rep. of Germany | 381/88 |

OTHER PUBLICATIONS

"Labyrinth Speakers for Hi Fi", D. B. Weems, Popular Electronics, Jan. 1972, p. 40.

D. B. Weems, "The Amazing Maze", Winter, 1973 issue of Stereo, p. 54.

*Primary Examiner*—Forester W. Isen

[57] ABSTRACT

A high efficiency labyrinth type enclosure uses chambers of triangular crossectional area and a single speaker with two separate voice coils, in conjunction with two speaker back wave paths, one tuned for woofer frequencies and the other tuned for subwoofer frequencies, to simultaneously reproduce all woofer and subwoofer frequencies of both channels of a stereo signal.

1 Claim, 3 Drawing Sheets

FIG.7
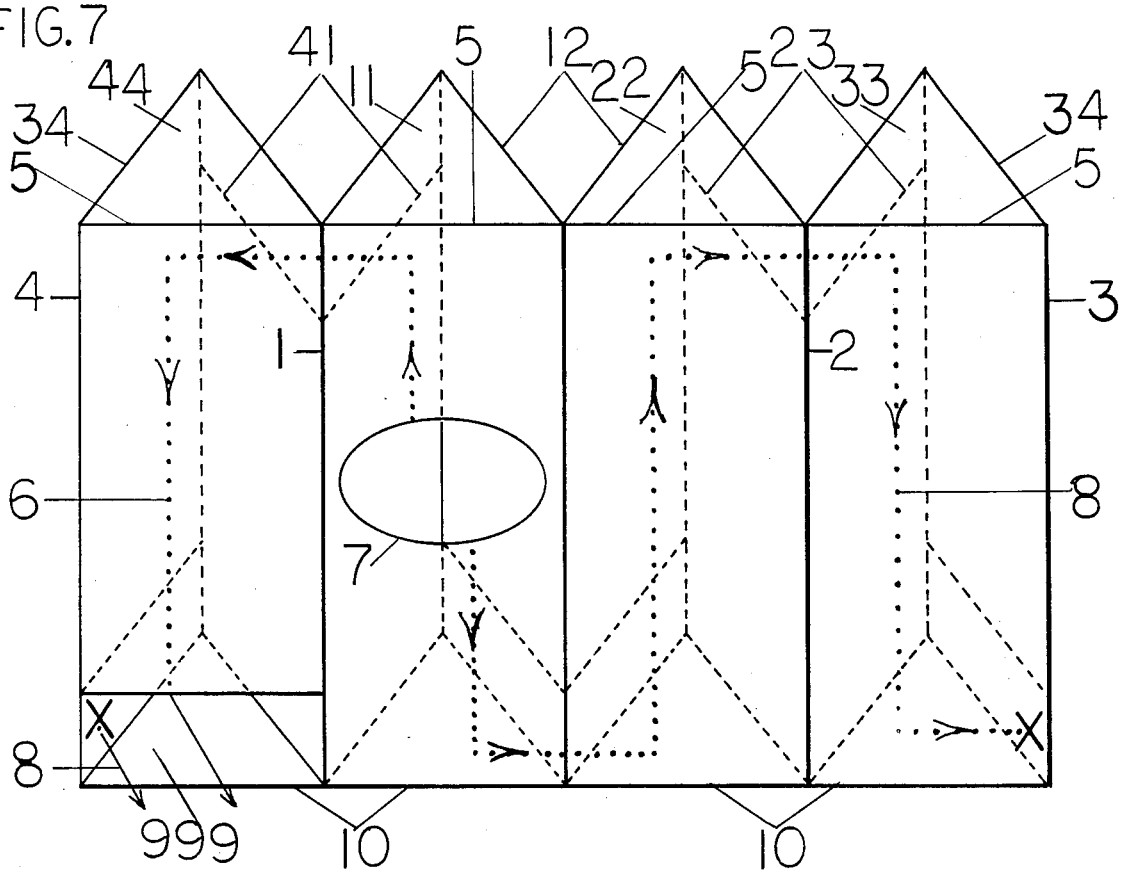
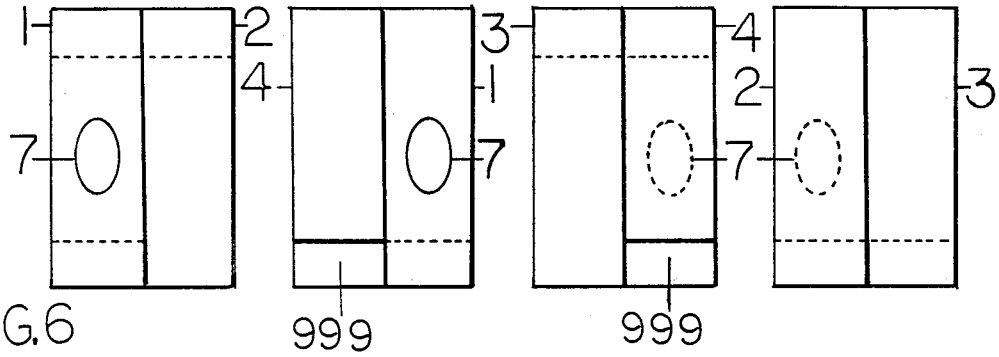
FIG.6
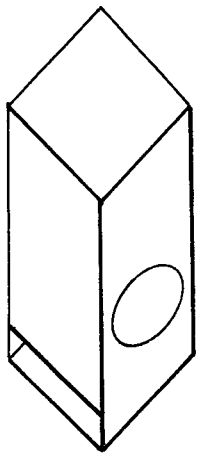
FIG.8

SINGLE SPEAKER, DOUBLE TUNED LABYRINTH TYPE ENCLOSURE

BACKGROUND OF THE INVENTION

The present invention generally relates to speaker enclosures, and more specifically to a single speaker, labyrinth type enclosure, that can be used to simultaneously reproduce the woofer and subwoofer frequencies of a stereo singal. The single speaker used has two seperate voice coils, such as the Pyle Driver, 8-inch subwoofer speaker, model W830D, manufactured by Pyle Industries, Inc., 501 Center Street, Huntington, IN 46750; while the enclosure has two seperately tuned, labyrinth type, speaker back wave paths; one tuned for woofer frequencies and the other tuned for subwoofer frequencies. Since low bass frequencies of about below 200 Hertz are not directional to the human ear, combining the low and very low woofer and subwoofer frequencies of a stereo signal, by connecting each channel of a stereo signal to a seperate voice coil of a single speaker, does not reduce the stereo effect in any way.

Before digital recording, either on tape or on compact discs was available, analog recording, which was not as good, did not require speakers to reproduce subwoofer frequencies, since it was almost impossable to record these frequencies and was rarely done so. However, with the advent of digital recording which could record and play back these frequencies for the first time, the almost universal type of sealed, air suspension, low efficiency, type of enclosure, was no longer satisfactory; since it could not reproduce subwoofer frequencies unless made exptremely large; and even then, not very well. This is the reason for this invention; to provide a high efficiency, economical alternative to the air suspension speaker system.

Labyrinth type enclosures and the principles of operation thereof, are very well known and therefore, will not be described in very great detail. Excellent articles about labyrinth type enclosures can be found in the January, 1972 issue of Popular Electronics, including Electronics World, Page 40, entitled "Labyrinth Speaker Systems for Hi Fi?"; and in the Winter, 1973 issue of Stereo, Page 54, entitled "The Amazing Maze"; both of which were written by well known writer, David B. Weems.

The first speaker enclosure that did not increase the speaker free air resonance was patented by Benjamin Olney in 1936 (U.S. Pat. No. 2,031,500) and was essentially a long folded tube. The effective length of the labyrinth tube is usually selected to be approximately equal to a half wavelength of the speaker free air resonance frequency. At this length, the back wave is shifted 180 degrees out of phase with the speaker front wave, and reinforces it for a given range of frequencies. At a quarter wave length, the anti-resonant action of the pipe offers maximum damping to the speaker, at its free air resonant frequency, preventing excessive movement of the speaker cone at that frequency which could produce excessive volume, distortion, or may even rupture the speaker cone and destroy the speaker.

A labyrinth type enclosure has the unique ability of not increasing the free air resonance of the speaker mounted therewith, and can even lower the free air resonant frequency under certain conditions, allowing the speaker enclosure to reproduce a lower range of bass frequencies.

The effective length of the speaker back wave path, of a labyrinth type enclosure is always longer than the actual physical length of said path, since the air friction of the labyrinth tube can cause the speaker back wave to slow down its velocity, and thereby increase the effective length of said path. Air friction can be caused by internal surface area of the path, the type and amount of bends in the path, and lining or stuffing the path with acoustical material such as fiberglass. A tube of triangular cross sectional area, offers the least air friction to a speaker back wave.

While increasing the air friction of the speaker back wave path, and thereby its effective length, may seem an easy way of making the physical path shorter and decreasing the volume of the enclosure; there is a price that must be paid. The more air friction there is in the speaker back wave path, the greater the effective length, but the weaker the signal emerging from the path to reinforce the speaker front wave; with a corresponding loss of efficiency. However, many types of lower efficiency, labyrinth type of enclosures have been designed, where the speaker back wave has been significantly reduced to the point where only the speaker front wave is used to reproduce the bass frequencies of an audio signal.

There are several problems involved in designing a labyrinth type enclosure, with respect to the cross sectional area of the speaker back wave path. If the cross sectional area is too large, the enclosure ceases to act as a labyrinth type, and acts as a variation of an infinite baffle. If the cross sectional area is too small, it ceases to act as a labyrinth type, and acts as a variation of a tuned column speaker, and increases the free air resonant frequency of the speaker used therewith.

With respect to using an enclosure to reproduce both woofer and subwoofer frequencies simultaneously, approximately below 200 Hertz, there is the same type of problem that occurs with every other type of speaker enclosure. Usually, the vented type of speaker enclosure is primarily used to help the speaker reproduce the low frequencies that a speaker cannot do well by itself, by inverting the phase of the speaker back wave, and using it to reinforce the speaker front wave for a limited range of low frequencies; which also helps to increase enclosure efficiency and reduce distortion.

If the enclosure is designed to reproduce the woofer range of frequencies, deep fundamental tones and overtones in the subwoofer range are not reproduced at usuable volume, and the speaker system is easily overloaded by subwoofer frequency signals. If the enclosure is designed to reproduce subwoofer frequencies, then woofer frequencies are weak, and the speaker system can be overloaded by woofer frequencies in the audio signal. The answer to this problem is in effect, to use two separate speaker systems; with one tuned to woofer frequencies, and the other to subwoofer frequencies, which is commonly done; or to design one enclosure that has two separately tuned paths for the woofer and subwoofer frequencies, which is one of the objects of this invention.

Other types of non-labyrinth speakers are known which utilize various partitions therein to either increase the effective length of a path, to produce a horn having an increasingly large cross sectional area, or to serve as baffles. For example, U.S. Pat. No. 3,327,808 discloses a loudspeaker housing having as its object to obtain an improved bass response. However, the loudspeaker housing disclosed in this patent is for a resonant column-type enclosure, consisting of a speaker at one end of the tube, and a series of constrictions at the other end. The constrictions appear in the housing outer wall and the constrictions or apertures have dimensions selected to make the same frequency selective by producing inductive effects and acting to cut off higher frequencies. The resonant column may be folded or telescoped, but it is shorter in length than a labyrinth type enclosure.

More importantly, the resonant column increases the free air resonance frequency of the speaker housed in it, and has an irregular polar sound distrabution curve. This is its main disadvantage. For a discussion of resonant column type enclosures, see "How to Build Speaker Enclosures", by Alex Badmaieff and Don Davis, Howard W. Sams & Co., 1973, page 115. In introducing the invention, the patentee of the patent distinguishes his invention by stating that his structure should not be confused with an acoustic labyrinth.

In U.S. Pat. No. 2,646,852, for a loud-speaker cabinet, the patentee discloses an enclosure provided with a plurality of internally spaced partitions. The partitions and apertures or openings between adjacent chambers or compartments is selected to provide one tortuous path which leads to a closed end, the reflected sound being retransmitted through its initial path and ultimately out through a port located near the loudspeaker. This construction is not a labyrinth type, and tends to increase the free air resonance frequency of the speaker.

Numerous types of construction are also known which utilize internal partitions to generate or form a tortuous path for the front or back wave produced by a speaker. For example; the following U.S. patents disclose various constructions of generally horn type enclosures; U.S. Pat. Nos. 2,224,919; 2,310,243; 2,971,598; and 3,642,091.

In each case, the partitions are generally arranged to produce a tortuous path which has an increasingly large cross sectional area to either the speaker front or back wave. Accordingly, the devices disclosed are not labyrinth type enclosures with their associated desirable characteristics.

A twin equilateral sound speaker enclosure is disclosed in U.S. Pat. No. 3,529,691. The primary object of this invention is to provide 360-degree dispersion of the sound over a wide frequency range. This is achieved by utilizing an enclosure provided with three substantially concentric tubes together forming a continuous path. However, the speaker is mounted in the central portion of the enclosure in such a manner that it is the front wave which is caused to propagate through the tortuous path in such a manner that it is the front wave which is caused to propagate through the tortuous path formed by the tubes, while the speaker back wave is completely enclosed.

Speakers, such as the type shown in FIG. 2, generally come in a circular shape, and have an effective cone area, which must be considered in the design of labyrinth type enclosures. The approximate radiation pattern of the speaker front wave is in a 360-degree direction perpendicular to the front of the speaker, as shown by the vertical arrow of FIG. 2, while the speaker back wave path is in an approximately 360-degree direction perpendicular to the speaker front wave, as shown by the horizontal arrows of FIG. 2. In the normal type of labyrinth enclosure, the speaker is mounted at the closed end of the tube. If the speaker is mounted in the enclosure with the speaker back wave path in the same direction as the speaker front wave, the back wave is entirely radiated in a 360-degree direction against the sides of the enclosure, and then forced to change direction by 90-degrees to travel down the tube which reduces the strength of the speaker back wave.

If the speaker is mounted in the end of the tube, with half of the speaker backwave radiating into a side panel while the other half radiates in the direction of the enclosure speaker back wave path, then the strength of the speaker back wave is reduced by the half that is reflected off the side panel and made to change direction by 180-degrees; and there may be some phase distortion and concellation problems at a certain range of frequencies.

Up to now, it was generally believed that, possibly, to decrease the loss of the speaker back wave caused by the method of mounting the speaker in the enclosure, as described above, the speaker back wave had to be initially propagated into a chamber behind the speaker that had a larger cross sectional area than the rest of the tube. It was also believed that the cross sectional area of said tube, had to be a little larger than the effective cone area of the speaker it was used in conjunction with. However, it was discovered, that if the shape of the tube used was triangular, which has the least amount of air friction of any other shape tube, the tube could be made smaller in cross sectional area, but had to be longer in length, to compensate for the fact that a triangular tube does not increase the effective length of a speaker back wave passing through it. The net result was that the volume of the tube was only decreased slightly more than about 9%; but the speaker back wave that emerged from the vented labyrinth type enclosure, was much stronger, and could reinforce the speaker front wave to a much greater degree; a most worthwhile and desirable improvement.

The type of bends in the speaker back wave path also effect the air friction of the tube, with a sharp, abrupt bend having more air friction than a more gradual bend; as disclosed by the abrupt bend in the path illustrated by the left bottom side of FIG. 5, of the woofer back wave path 6, as compared to the use of a deflector panel 20, at the right bottom side of FIG. 5, of the subwoofer path 8.

Another consideration was how to effectively couple the speaker back wave of a single speaker, into two seperate labyrinth type tubes of different lengths, so that the speaker backwave is evenly divided between the two tubes. Normally, in such a case, the speaker back wave would follow the path of least resistance, which would be the shorter path. The solution, as shown by FIGS. 1, 5, 6, and 7, was to mount the speaker on the front panel 1, in a speaker mounting hole 7, at a preselected distance from both ends of the tube, to form two speaker back wave paths of different lengths. The cross sectional area of the speaker, when mounted in the speaker mounting hole 7, also helped to isolate the two paths. The cross sectional area of the triangular tube was also made less than the minimum believed requirement of having to be a little greater than the effective area of the cone of the speaker being used, which also helped to equalize the strength of the speaker back wave that is radiated into each path.

This also allowed the speaker back wave to be very efficiently radiated into the enclosure; since the speaker back wave path was simultaneously caused to radiate in two directions at the same time, that were in opposite directions to each other, but which coincided with the direction of both speaker back wave paths of the enclosure.

The invention, which basically consists of a rectangular tube with partitions forming the diagonals of the square cross sectional area, results in an extremely regid enclosure, that has no vibrating panels than can produce sound colorations in the reproduced signal.

Further, since the invention can have two seperate vents; one for woofer frequencies, and the other for subwoofer frequencies, at a right angle to each other, with the woofer vent being directly under the side panel that the speaker is mounted on, it is possible to adjust the sound balance of the woofer and subwoofer frequencies by rotating the speaker enclosure. As is well known, placing a speaker enclosure in a corner of a room, increases the strength of the bass frequencies reproduced by a speaker system since the corner of the room acts as if it is part of a horn. Refer to the left top view of FIG. 1.

If the enclosure is placed in a corner of a room, with the outside end of partition 41 pointing in the direction of the longer wall next to it, the woofer frequencies from the speaker and the woofer vent 9, will be made stronger; with the strongest reproduction of the woofer frequencies being when the entire enclosure is rotated 45-degrees in a counter clockwise direction, with the woofer vent 9, at a right angle to the longer wall.

If the enclosure is placed at the opposite end of the same room, with the outside end of partition 23 pointing in the direction of the longer wall next to it, the subwoofer frequencies from the speaker and especially the subwoofer vent 99, will be made stronger; with the strongest reproduction of the subwoofer frequencies being when the entire enclosure is rotated in a clockwise direction by 45-degrees, with the subwoofer vent sitting at a right angle to the longer wall.

Obviously, if an enclosure was made that was a mirror image of the enclosure shown in FIG. 1, the opposite of the above would be true. The above speaker system placements could be made to compensate for one's taste in sound, or to compensate for the acoustics of a particular room.

SUMMARY OF THE INVENTION

The following are objects of this instant invention:

(1) To provide a high efficiency, vented, speaker system which provides improved performance as compared to prior art speaker systems; having all the unique and desirable characteristics of a labyrinth type enclosure, as a better alternative to the almost universally used, low efficiency, air suspension, sealed type of speaker system;

(2) to provide a labyrinth type enclosure of reasonable size and shape, made up of rectangular panels, which is simple in construction and economical to manufacture;

(3) to provide an extremely regid enclosure to prevent sound colorations caused by enclosure resonances;

(4) to provide a labyrinth type enclosure that does not increase the frequency of the free air resonance of the speaker mounted therein;

(5) to provide a high efficiency speaker system which provides improved speaker back wave coupling with the enclosure;

(6) to provide a labyrinth type enclosure that may be used to reproduce woofer and subwoofer frequencies, separately and simultaneously;

(7) to provide a labyrinth type construction, enclosure, that may be used in conjunction with a single speaker having two separate voice coils, to reproduce all the woofer and subwoofer frequencies of a stereo signal, with woofer frequencies generally considered to be between 800 Hertz to 50 Hertz, and subwoofer frequencies being below 50 Hertz;

(8) to provide a speaker system with separate vents for the woofer and subwoofer frequencies, at right angles to each other, so that the balance between said frequencies may be adjusted by rotating the entire enclosure;

(9) to provide a speaker system which prevents speaker back wave path reflected resonances using triangular chambers having no large parallel sides; and in the speaker mounting chamber, the small parallel ends of the chamber being at different distances from the speaker; and

(10) a speaker systemm with separate labyrinth type paths for woofer and subwoofer frequencies, whereby the proportion of the signal strength applied to each path can be adjusted to a limited degree by changing the cross sectional area of the speaker back wave path at a plurality of locations;

(11) to provide an economical speaker system using a single speaker with two separate voice coils, that allows simultaneous reproduction of all woofer and subwoofer frequencies of a stereo signal, that allows connection to a stereo system, by means of two suitable 6-db per octave crossover networks, to a single audio power amplifier, without the requirement of a separate amplifier;

(12) to provide an economical, high efficiency speaker system, to simultaneously reproduce all woofer and subwoofer frequencies of a stereo signal, with a single speaker that can be connected to a new or existing stereo speaker system, with only a pair of woofer crossovers; without the need of a pair of expensive, power consuming, subwoofer crossovers required in addition to the woofer crossovers;

(13) to provide a speaker enclosure that uses a single speaker to simultaneously reproduce all woofer and subwoofer frequencies of a stereo signal, which eleimates phase and other types of distortions and imbalances, created when different speakers are used in the same or different enclosures, to reproduce woofer and subwoofer frequencies;

(14) to provide a labyrinth type enclosure with high efficiency and improved performance, with the same or reduced volume, by use of a series of triangular shaped chambers;

(15) to provide a type of labyrinth construction that can be easily scaled up or down in size, resulting in compact enclosures for shelves, and large, auditorium speaker systems.

BRIEF DESCRIPTIONS OF THE DRAWINGS

Further advantages of this invention will become apparent from a reading of the following specifications describing two illustrative embodiments of this invention. This specification is to be taken with the accompanying drawings, in which:

FIG. 1 consists of four sets of views of the invention, with each set consisting of a front view and associated top view. Going from left to right, the first set is a front and top view of the invention, with the three succeeding sets of views, showing the invention rotated in 90-degree steps, in a counter clockwise direction. For clarity, the speaker that is used in conjunction with the enclosure, as shown in FIG. 2, is not shown; and note that although the speaker mounting hole 7 is actually round, it appears elliptical in the perspective of the front views chosen;

Figures 1, 2, 3, 4:
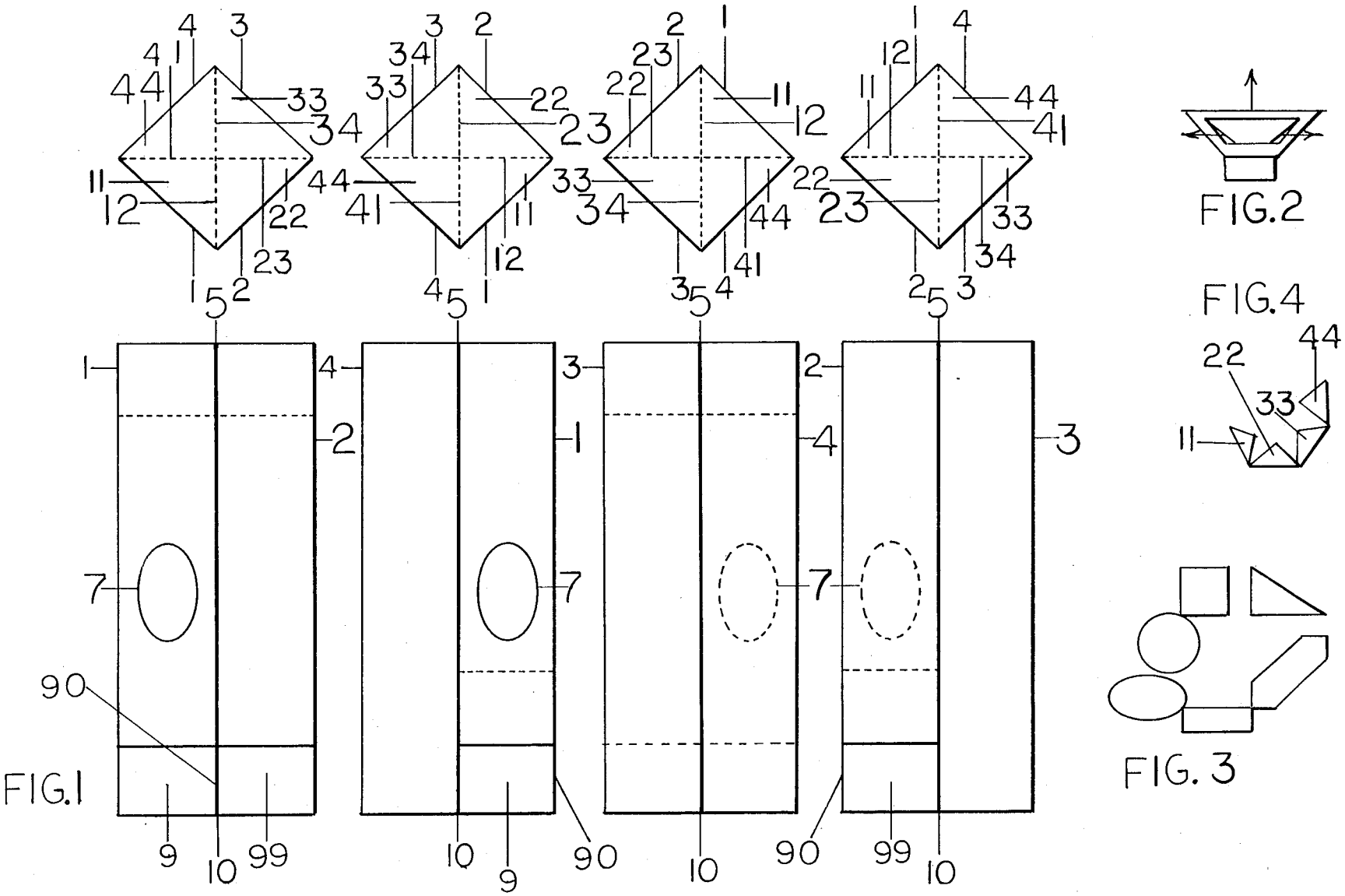
FIG. 2, is a simplified side view of a common type of circular speaker, with the vertical arrow showing the general direction of radiation of the speaker front wave, with the horizontal arrows showing the general direction of the radiation of the speaker back wave.
FIG. 3 shows some of the different types of cross sectional area shapes that a labyrinth type tube may have.
Figure 5:
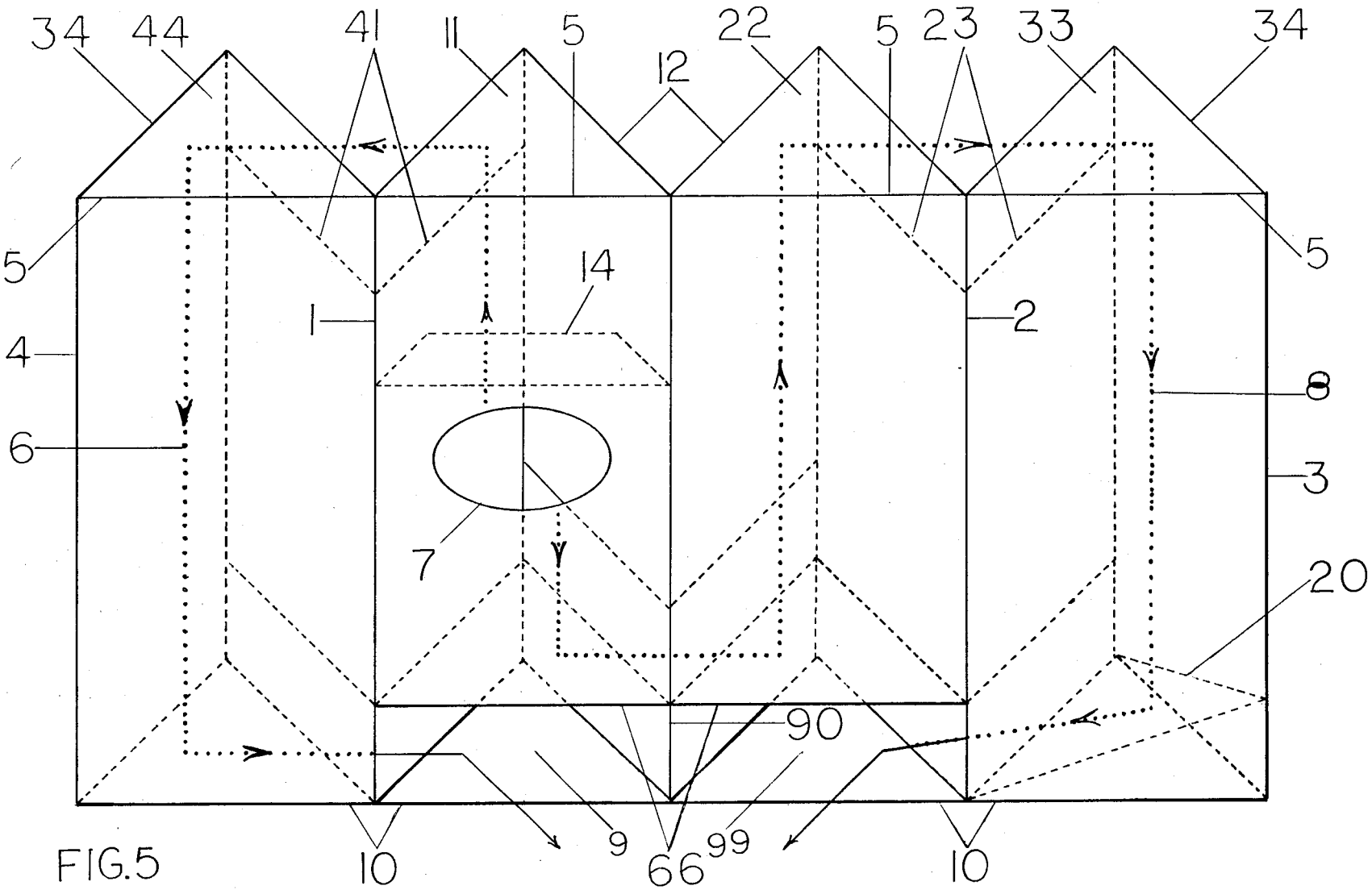

FIG. 4 shows a top view of the enclosure, with partitions 12, 23, 34, and 41 of FIG. 1, split vertically down the middle of their thickness, and slightly separated into the four triangular chambers, 11, 22, 33, and 44, that make up the enclosure;

FIG. 5 is a simplified view of the four triangular chambers, 11, 22, of FIG. 4, placed in a straight line to clearly show the two separate paths of the enclosure speaker back wave; the woofer back wave path 6 and the subwoofer backwave path 8, and their associated woofer vent 9, and subwoofer vent 99;

FIG. 6 shows a series of front views, each rotated in 90-degree steps in a counter clockwise direction, similar to FIG. 1. Note that the corresponding top views of FIG. 1 are identical to the associated top views that are not shown in FIG. 6, and may be used in conjunction therewith, of an alternate embodiment of the invention of FIG. 6. The main difference between the embodiment of FIG. 1 and FIG. 6, is that FIG. 1 has two separate vents, 9 and 99; while FIG. 6 discloses a combined vent, 999; (actually, 9 is the woofer vent, 99 is the subwoofer vent, and 999 is the combined woofer and subwoofer vent.)

FIG. 7 is a view, similar to FIG. 5, of the alternate embodiment of the invention shown in FIG. 6;

FIG. 8 is a perspective view of the alternate embodiment of the invention, showing the location of the one vent and the speaker.

DESCRIPTION OF THE PREFERRED EMBODIMENTS

Referring specifically to the figures, in which identical or similar parts are designated by the same numeral throughout. Note that the drawings are simplified, and the proportions exaggerated for clarity; and the drawings should not be misconstrued as limiting the scope of the invention in any way.

FIG. 1 has four sets of views of the invention's first preferred embodiment; each set consisting of a front view and associated top view. Going from left to right, the first set is the front and top view of the embodiment of the invention, with the three succeeding sets of views each showing the invention being rotated in 90-degree steps in a counter clockwise direction from the previous set of views. The following description also applies to FIG. 5.

The enclosure is in the shape of a vertical tube of square cross sectional area; having four side panels, 1, 2, 3, and 4; a top panel 5; a bottom panel 10; and a vent panel 66, not shown in FIG. 1. There is a speaker mounting hole 7, on side panel 1. Note that due to the perspective of the frontal views chosen, the circular speaker mounting hole 7, is seen as an ellipse. The interior of the enclosure is divided into a series of four chambers, 11, 22, 33, and 44, of triangular cross sectional area, by partitions 12, 23, 34, and 41.

Partition 34 extends from the top panel 5, to the bottom panel 10, and is the only one of the four partitions to do so. The space between the top panel 5, and the top of partition 41, forms a port connecting the upper portions of chambers 44 and 11. The space between the bottom panel 10 and the bottom of partition 41, forms the woofer vent 9, which vents from the bottom portion of chamber 44, under chamber 11, to the atmosphere. Partition 12 extends from the top panel 5, down towards the vent panel 66, and the space between the bottom of partition 12 and the vent panel 66 forms a port connecting the bottom portions of chambers 11 and 22. The space between the top panel 5 and the top of partition 23, forms a port connecting the upper portions of chambers 22 and 33. The space between the bottom of partition 23 and the bottom panel 10 forms the subwoofer vent 99, which vents from the bottom portion of chamber 33, under chamber 22, to the atmosphere.

FIG. 5 also discloses the two separate speaker back wave paths of the enclosure; the woofer back wave path 6 and the subwoofer back wave path 8. The woofer back wave path 6, as shown by the dotted line with arrows, begins at the top of the speaker mounting hole 7, in chamber 11, and travels up towards the top panel 5; through the port made by the space between the top panel 5 and the top of partition 41 connecting the upper portions of chambers 11 and 44; into chamber 44.

The path continues down towards the bottom panel 10, through the port formed by the bottom of partition 41 and the bottom panel 10, under chamber 11, and out to the atmosphere through the woofer vent 9, to reinforce the speaker front wave at woofer frequencies.

The subwoofer back wave path 8, as shown by the dotted line with arrows, begins in chamber 11, at the bottom of the speaker mounting hole 7, and travels down towards the vent panel 66, through the port formed by the bottom of partition 12 and the vent panel 66, which connects the bottom portions of chambers 11 and 22; into chamber 22.

The path continues up towards the top panel 5, through the port formed by the top panel 5 and the top of partition 23, connecting the top portions of chambers 22 and 33; into chamber 33. Then the path goes down towards deflector panel 20, through the port formed by the bottom of partition 23 and the bottom panel 10, under chamber 22, and out to the atmosphere through the subwoofer vent 99, to reinforce the speaker front wave at subwoofer frequencies.

A back wave proportion panel 14, is used to change the proportion of the strength of the speaker back wave, applied simultaneously to the woofer back wave path 6, and the subwoofer back wave path 8, within a limited range, by reducing the area of the cross section of chamber 11, at some location.

FIG. 6 shows a series of front views of an alternate embodiment of the invention. Going from left to right, each view of the series is a front view of the invention, with the entire enclosure rotated in 90-degree steps in a counter clockwise direction, in a manner similar to FIG. 1. The four top views of FIG. 1 are identical to the corresponding front views of FIG. 6, and may be used in conjunction therewith. Also disclosed, is the relative position of the speaker mounting hole 7, and the combined woofer and subwoofer vent 999. The primary difference between the embodiments of the invention shown in FIGS. 1 and 6, is that FIG. 6 shows the invention with two separate vents; the woofer vent 9 and the subwoofer vent 99; while FIG. 6 shows the invention having only one vent; the combined woofer and subwoofer vent 999. Further disclosed, are the relative positions of the side panels 1, 2, 3, and 4, in the front views. FIG. 7 is a view, similar to FIG. 5, of the alternate embodiment of the invention, as previously shown in FIG. 6, showing the four side panels, 1, 2, 3, and 4, with their associated chambers, 11, 22, 33, and 44, respectively, and the top panel 5 and bottom panel 10. Further disclosed are partitions 34, 41, 12, and 23, and the speaker mounting hole 7, of chamber 11. The woofer back wave path 6, as shown by the dotted line with arrows, begins in chamber 11, at the top of the speaker mounting hole 7, travels up towards the top panel 5, through the port formed by the top panel 5 and the top of partition 41, which connects the upper portions of chambers 11 and 44; into chamber 44. The woofer back wave path continues in a downward direction towards the bottom panel 10, and through the combined woofer and subwoofer vent 999, into the atmosphere, to reinforce the speaker front wave at woofer frequencies.

The subwoofer back wave path 8, as shown by the dotted line with arrows, begins in chamber 11, at the bottom of the speaker mounting hole 7, and travels towards the bottom panel 10, and through the port formed by bottom of partition 12 and the bottom panel 10, connecting the bottom portions of chambers 11 and 22; into chamber 22. The path continues in an upward direction towards the top panel 5, and through the port formed by the top of portion 23 and the top panel 5, which connects the upper portions of chambers 22 and 33; into chamber 33. The path further continues down towards the bottom panel 10, through the port formed by the bottom of partition 34 and the bottom panel 10, which connects the bottom portions of chambers 33 and 44; to point "X". Point "X" corresponds to the point X shown at the bottom left corner of FIG. 6, showing the subwoofer back wave path 8, which vents to the atmosphere through the combined woofer and subwoofer vent 999, to reinforce the speaker front wave at subwoofer frequencies.

It is to be understood that the foregoing descriptions of the two embodiments of the invention illustrated herein, are only exemplary of this instant invention, and various modifications to these embodiments shown may be made without departing from the spirit and scope of this invention.

What is claimed is:

1. A labyrinth type enclosure with speaker means used in conjunction therewith, said enclosure not substantially increasing the free air resonant frequency of said speaker means, said speaker means having a front and back wave, said enclosure having side panels, a top and bottom panel, and internal partitioning means to form chambers of triangular cross sectional area, interconnected by ports to form a continuous tube, said speaker means mounted on one of said side panels so that said front wave radiates into the atmosphere, and said back wave radiates into one of said chambers, means for reducing said cross sectional area at a point along said tube, and venting means for radiating said back wave, into said atmosphere.

* * * * *